US009609434B2

(12) United States Patent
Rodigast et al.

(10) Patent No.: US 9,609,434 B2
(45) Date of Patent: Mar. 28, 2017

(54) DEVICE AND METHOD FOR DRIVING A SOUND SYSTEM AND SOUND SYSTEM

(75) Inventors: René Rodigast, Tautenhain (DE); Michael Strauss, Ilmenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1898 days.

(21) Appl. No.: 11/748,373

(22) Filed: May 14, 2007

(65) Prior Publication Data

US 2007/0269062 A1 Nov. 22, 2007

Related U.S. Application Data

(63) Continuation of application No. PCT/EP2005/012057, filed on Nov. 10, 2005.

(30) Foreign Application Priority Data

Nov. 29, 2004 (DE) ..... 10 2004 057 500

(51) Int. Cl.
*H04R 5/02* (2006.01)
*H04R 1/40* (2006.01)
(Continued)

(52) U.S. Cl.
CPC ..... *H04R 5/02* (2013.01); *H04R 1/403* (2013.01); *H04R 3/12* (2013.01); *H04R 27/00* (2013.01);
(Continued)

(58) Field of Classification Search
CPC . H04R 5/02; H04R 5/12; H04R 1/403; H04R 3/12; H04R 27/00; H04R 2201/403
(Continued)

(56) References Cited

U.S. PATENT DOCUMENTS 5,109,416 A * 4/1992 Croft ..... 381/304
5,452,360 A 9/1995 Yamashita et al.
(Continued)

FOREIGN PATENT DOCUMENTS

DE 10254404 B4 11/2004
JP H04-132499 5/1992
(Continued)

OTHER PUBLICATIONS

The Notification of Reasons for Refusal, mailed Jun. 2, 2009, from parallel Japanes application No. 2007-541754.
(Continued)

*Primary Examiner* — Disler Paul
(74) *Attorney, Agent, or Firm* — Michael A. Glenn; Perkins Coie LLP

(57) ABSTRACT

A driving device for a sound system by loudspeaker signals, wherein the sound system has a wave field synthesis loudspeaker array and one or several supply loudspeakers arranged separate from the wave field synthesis array includes an audio input for receiving at least one audio signal from at least one sound source, a position input for receiving information on a position of the sound source, a wave field synthesis unit for calculating loudspeaker signals for the loudspeakers of the wave field synthesis loudspeaker array, and a provider for providing the loudspeaker signal for the one or the several supply loudspeakers. The driving device enables a sound system by means of which sound localization becomes possible for the audience and at the same time pleasant levels can be achieved also in the first rows of the audience.

16 Claims, 2 Drawing Sheets

(51) Int. Cl.
*H04R 3/12* (2006.01)
*H04R 27/00* (2006.01)
*H04S 3/00* (2006.01)

(52) U.S. Cl.
CPC ..... *H04S 3/00* (2013.01); *H04R 2201/403* (2013.01); *H04S 2420/13* (2013.01)

(58) Field of Classification Search
USPC ..... 381/1, 17–18, 309–310
See application file for complete search history.

(56) References Cited

U.S. PATENT DOCUMENTS

| | | | | |
|---|---|---|---|---|
| 5,822,440 | A | 10/1998 | Oltman et al. | |
| 5,870,484 | A * | 2/1999 | Greenberger | 381/300 |
| 6,584,202 | B1 | 6/2003 | Montag et al. | |
| 6,931,134 | B1 * | 8/2005 | Waller et al. | 381/27 |
| 7,218,745 | B2 * | 5/2007 | McConnell et al. | 381/302 |
| 7,706,544 | B2 * | 4/2010 | Melchior | H04R 3/12 381/17 |
| 8,526,623 | B2 * | 9/2013 | Franck | 381/17 |
| 2004/0223620 | A1 | 11/2004 | Horbach et al. | |
| 2005/0175197 | A1 | 8/2005 | Melchior et al. | |
| 2006/0098830 | A1 * | 5/2006 | Roeder et al. | 381/310 |
| 2006/0109992 | A1 * | 5/2006 | Roeder | H04S 3/002 381/310 |
| 2008/0170729 | A1 * | 7/2008 | Lissaman et al. | 381/303 |
| 2011/0069850 | A1 * | 3/2011 | Harma | H04S 3/002 381/307 |

FOREIGN PATENT DOCUMENTS

| | | |
|---|---|---|
| JP | H05-300596 | 12/1993 |
| JP | H08-009490 | 1/1996 |
| JP | H10-243500 | 9/1998 |
| JP | 2001-517005 | 10/2001 |
| WO | WO 2003/071827 | 8/2003 |
| WO | WO 2004/047485 A | 6/2004 |
| WO | WO 2004/103024 A1 | 11/2004 |

OTHER PUBLICATIONS

Questioning Communication (with English Translation) mailed Nov. 1, 2010 in related Japanese Patent Application No. 2007-541754, 12 pages.

Berkhout A.J., et al., "Acoustic Control by Wavefield Synthesis," JASA 93, 1993.

M.M. Boone, et al., "Spatial Sound-Field Reproduction by Wave-Field Synthesis," Delft University of Technology Laboratory of Seismics and Acoustic , Journal of J. Audio Eng. Soc., Bd. 43, Nr. 12, Dec. 1995.

Diemer de Vries, "Sound Reinforcement by Wavefield Synthesis: Adaption of the Synthesis Operator to the Loudspeaker Directivity Characteristics," Delft University of Technology Laboratory of Seismics and Acoustics, Journal of J. Audio Eng. Soc., Bd. 44, Nr. 12, Dec. 1996.

R. Rabenstein, et al., "Raumklangwierdergabe und der MPEG-4 Standard: Das Carrouso-Projekt", 22 Tonmeistertagung, VDT International Audio Convention, Nov. 25, 2002.

S. Spors, et al., "High-Quality Acoustic Rendering with Wave Field Synthesis," Vision, Modeling, and Visualization 2002, Nov. 20, 2002.

G. Theile, et al., "Wellenfeldsynthese, NEUE Moeglichkeiten der Raeumlichen Tonaufnahme Und-Wiedergabe" FKT Fernseh und Kinotechnik, Fachverlag Schiele & Schon GMBH., Berlin, DE, BD. 57, Nr. 4, Apr. 2003.

* cited by examiner

DEVICE AND METHOD FOR DRIVING A SOUND SYSTEM AND SOUND SYSTEM

CROSS-REFERENCE TO RELATED APPLICATIONS

This application is a continuation of co-pending International Application No. PCT/EP2005/012057, filed Nov. 10, 2005, which designated the United States and was not published in English.

TECHNICAL FIELD

The present invention relates to audio reproduction systems and, in particular, to sound systems for supplying comparatively large reproduction spaces with sound.

BACKGROUND

Typical sound systems for supplying relatively large surroundings, such as, for example, a conference room on the one hand or a concert stage in a hall or even in the open air on the other hand, suffer from the problem that, due to the conventionally small number of loudspeaker channels used, a location-true reproduction of sound sources is ruled out anyway. However, even if a left channel and a right channel are used in addition to a mono-channel, the level problem will always remain. Thus, the rear seats, i.e. the seats far away from the stage, have to be provided with sound to the same extent as the seats close to the stage. If, for example, loudspeakers are only arranged in the front of the audience space or at the sides of the audience space, it will be inherently problematic that persons close to the loudspeaker will perceive the loudspeaker as exaggeratingly loud, so that the persons at the very back will still be able to hear something. Put differently, due to the fact that individual supply loudspeakers are perceived in such a sound scenario as point sources, there will always be persons saying it is too loud, whereas other persons will say it is too soft. The persons for which it is normally always too loud are the persons very close to the point source-type loudspeakers, whereas the persons for whom it is too soft are seated at a great distance from the loudspeakers.

In order to try and avoid these problems at least to a certain degree, one tries to arrange the loudspeakers at a higher position, i.e. above the persons who are seated close to the loudspeakers, so that they at least do not perceive the complete sound, but a considerable amount of the loudspeaker sound spreads above the heads of the audience and thus is not perceived by the audience in the front on the one hand and nevertheless provides the audience further back with a sufficient level on the other hand.

Other ways, in order not to overstrain the persons in the front rows, i.e. close to the loudspeakers, are providing a low level so that, of course, further back in the room there is a danger of everything being too soft again.

Directional perception is even more problematic. A single mono-loudspeaker in a conference room, for example, does not allow directional perception. It will only allow directional perception if the position of the loudspeaker corresponds to the direction. This is inherently due to the fact that there is only one single loudspeaker channel. However, even if there are two stereo channels, one can at most switch between the left and right channels, i.e. perform panning. This may be of advantage when there is only one single source. However, when there are several sources, localization, which is only possible very roughly with two stereo channels anyway, is completely impossible. Even with stereo, there is a directional perception, however, only in the sweet spot. With several sources, this directional experience will become more and more blurred with an increasing number of sources.

In other scenarios, the loudspeakers in medium-size to large auditories of this kind which are supplied with stereo or mono mixtures are arranged above the audience so that they cannot reproduce any directional information about the source anyway.

Although the sound source, i.e. a speaker or a theater actor, is on the stage, it will be perceived as coming from the lateral or centrally arranged loudspeakers. A natural perceptional direction, however, is still dispensed with. People are already satisfied when there is sufficient loudness for the audience at the back and when it is not unbearably loud for the audience at the front.

Certain scenarios operate with so-called "support loudspeakers" which are positioned close to a sound source. Here, one tries to restore natural audio localization. These support loudspeakers are normally driven without delay, whereas the stereo sound is delayed via the supply loudspeakers, so that the support loudspeaker will be perceived first and thus a localization becomes possible according to the law of the first wave front. Support loudspeakers, too, are problematic in that they are perceived as point sources. On the one hand, this has the result that a difference to the actual position of the sound emitter forms and that, additionally, there is the danger that this may again be too loud for the audience at the front, whereas it is too soft for the audience at the back.

On the other hand, support loudspeakers will only allow a real directional perception if the sound source, exemplarily a speaker, is in direct proximity to the support loudspeaker. This would work if a support loudspeaker was installed in the lectern and a speaker was always standing at the lectern, wherein it is impossible in this reproduction space for somebody to stand next to the lectern and speak to the audience.

With a local difference between the support loudspeaker and the sound source, the result for the listener will be an angular error in the directional perception which, in particular for listeners who may not be accustomed to support loudspeakers, but stereo reproduction, results in further uneasiness. One has found out that in particular when the law of the first wave front is used for operation and when a support loudspeaker is used, it is better to deactivate the support loudspeaker when the real sound source, i.e., for example, the speaker, has withdrawn too much from the support loudspeaker. Put differently, this point is related to the problem that the support loudspeaker cannot be moved so that, in order not to produce the uneasiness mentioned above among the audience, the support loudspeaker is deactivated completely when the speaker has withdrawn too much from the support loudspeaker.

As has already been mentioned, in support loudspeakers, conventional loudspeakers are usually used which in turn have the acoustic characteristics of a point source—as do the supply loudspeakers—the result in close proximity to the systems being too high a level which is perceived as being unpleasant.

SUMMARY

According to an embodiment, a device for driving a sound system by loudspeaker signals, the sound system having a wave field synthesis loudspeaker array and one or several supply loudspeakers arranged separate from the wave field synthesis loudspeaker array, may have: an audio input for receiving at least one audio signal from at least one sound source; a position input for receiving information on a position of the sound source; a wave field synthesis unit for calculating loudspeaker signals for the loudspeakers of the wave field synthesis loudspeaker array based on the position of the audio signal, based on the audio signal and based on a position of the loudspeakers of the wave field synthesis loudspeaker array so that a sound field produced by the wave field synthesis loudspeaker array allows localizing the sound source by a listener in a space supplied by the supply loudspeakers; and means for providing the loudspeaker signal for the one or the several supply loudspeakers on the basis of the audio signal, wherein the device for driving is implemented to drive the wave field synthesis loudspeaker array and the one or the several supply loudspeakers such that a wave front of the wave field synthesis loudspeaker array arrives at a listener before a wave front of the one or the several supply loudspeakers.

According to another embodiment, a method for driving a sound system by loudspeaker signals, the sound system having a wave field synthesis loudspeaker array and one or several supply loudspeakers arranged separate from the wave field synthesis loudspeaker array, may have the steps of: receiving at least one audio signal from at least one sound source; receiving information on a position of the sound source; calculating loudspeaker signals for the loudspeakers of the wave field synthesis loudspeaker array based on the position of the audio signal, based on the audio signal and based on a position of the loudspeakers of the wave field synthesis loudspeaker array so that a sound field produced by the wave field synthesis loudspeaker array allows localizing the sound source by a listener in a space supplied by the supply loudspeakers; and providing the loudspeaker signal for the one or the several supply loudspeakers on the basis of the audio signal, wherein the method for driving is performed such that the wave field synthesis loudspeaker array and the one or the several supply loudspeakers are driven such that a wave front of the wave field synthesis loudspeaker array arrives at a listener before a wave front of the one or the several supply loudspeakers.

According to another embodiment, a sound system may have: a wave field synthesis loudspeaker array; one or several supply loudspeakers; and a device for driving as mentioned above.

An embodiment may have a computer program having a program code for executing the method as mentioned above when the computer program runs on a computer.

The present invention is characterized in that a wave field synthesis loudspeaker array is integrated into a sound system typically already present in order to eliminate the problems relating to high sound level differences in the audience space and poor directional perception or wrong directional perception.

The inventive device for driving a sound system by loudspeaker signals, the sound system comprising a wave field synthesis loudspeaker array and one or several supply loudspeakers, comprises an audio input for receiving the audio signal from at least one sound source, a position input for receiving information on a position of the sound source, a wave field synthesis unit for calculating loudspeaker signals for the loudspeakers of the wave field synthesis loudspeaker array, and means for providing the loudspeaker signals for the one or several supply loudspeakers.

By combining the supply loudspeakers usually already present with a wave field synthesis loudspeaker array, local perception of the sound sources which is precise and even works for movable sound sources is achieved, while at the same time the level problem is eliminated in that a loudspeaker array will not longer be perceived as a point source but as a line source, in that the loudspeakers arranged close to a listener are driven more softly compared to a point source loudspeaker, since there are further array loudspeakers which are further away from the listener and nevertheless bring sound energy to the sound space.

However, on the other hand, the major sound supply is achieved by conventional supply loudspeakers still present. Due to the sound energy provided by the wave field synthesis loudspeaker array, the level for the front loudspeakers, i.e. those close to the listeners in the front rows, can be implemented to be lower, since the front rows are provided with sound by the wave field synthesis array advantageously arranged in front in a pleasant and, in particular, direction-sensitive manner.

The present invention thus provides an improvement in conventional sound systems by means of the additionally included wave field synthesis sound by providing and driving the additional wave field synthesis loudspeaker array.

In addition, the present invention is of advantage in that the auditive perception of source positions is supported and improved. Furthermore, the energy distribution and the directional perception in auditories are improved by the inventive concept, which results in an improved audibility of a speaker, in particular when being applied for conference systems.

Apart from conference systems, however, the present invention may also be employed with advantage in the installation and event fields and, of course, in particular for larger sound systems.

In addition, the present invention is of advantage in that the hardware already present may be used for large-area sound supplies. This, on the one hand, affects the audio mixing consoles already there and, on the other hand, the supply loudspeakers which are typically already there and are supplemented by the wave field synthesis array and/or the device for controlling the supply loudspeakers and/or the wave field synthesis array.

In embodiments, the inventive driving device will only act on the level of normal loudspeaker signals of the supply loudspeakers to produce attenuation compared to a case with no wave field synthesis array. In addition, in order to make use of the law of the first wave front in this embodiment, a delay for the sound signals of the supply loudspeakers in the range between one and 100 milliseconds is introduced to additionally support directional perception.

Otherwise, the driving device is transparent for the output signal of a mixing console, which in equipment of this kind is typically present anyway.

Including the directional wave field synthesis front array provides a pleasant sound level distribution including real directional perception, is implementable in compact hardware and provides the absolutely necessary additional sound supply for the first rows of listeners which are frequently under-supplied or provided with too loud a sound with a natural listening experience. This will be of particularly high importance when it is considered that in different conference rooms and/or concert halls so-called VIPs, i.e. persons on which the financial existence of the theatre etc. may depend, are seated in the first row, i.e. in the area which in the prior art has been particularly problematic and which will particularly profit from the inventive application of the wave field synthesis front array.

It is to be pointed out here that the inventive concept, compared to complete wave field synthesis equipment, is of advantage in that it may be implemented at a considerably lower price, since a wave field synthesis array is not employed on four sides and thus considerable costs must be spent on loudspeakers, wiring, etc. Instead, only a front array is used to be able to position the virtual sources which typically are at the front. The "sweet spot" of this open wave field synthesis array is, when the sources are only in the front, as large as in a full wave field synthesis scenario. The sweet spot will only be limited with sources in other directions.

The quality of the sound reconstruction by means of the planar wave field synthesis front loudspeaker array may possibly decrease for the back listener regions. However, this is not problematic in that for the eyes, too, the stage will be further away and localization differences become small since, due to the greater distance, the locations will so to speak more closer together. The wave field synthesis reconstruction of a straight front array in this case will also result in a situation where reconstruction will be the poorer the further one is away from the array. Since, however, this matches natural perception, this disadvantage makes no real difference. The back rows are catered for by the large and high-power supply loudspeakers which will at least achieve sufficient loudness for the back rows.

If a complete wave field synthesis array were used in such a case, which, in particular for large stages, would only be possible at great expenditure anyway, this would not result in a considerable sound improvement, in particular in the case in which all sound sources are positioned at the front anyway. The inventive concept in which normal supply loudspeakers cooperate with a wave field synthesis loudspeaker array thus provides nearly the same quality as a listener area completely surrounded by wave field synthesis arrays, but at considerably reduced cost.

BRIEF DESCRIPTION OF THE DRAWINGS

Embodiments of the present invention will be detailed subsequently referring to the appended drawings, in which.

DETAILED DESCRIPTION

Figure 1:
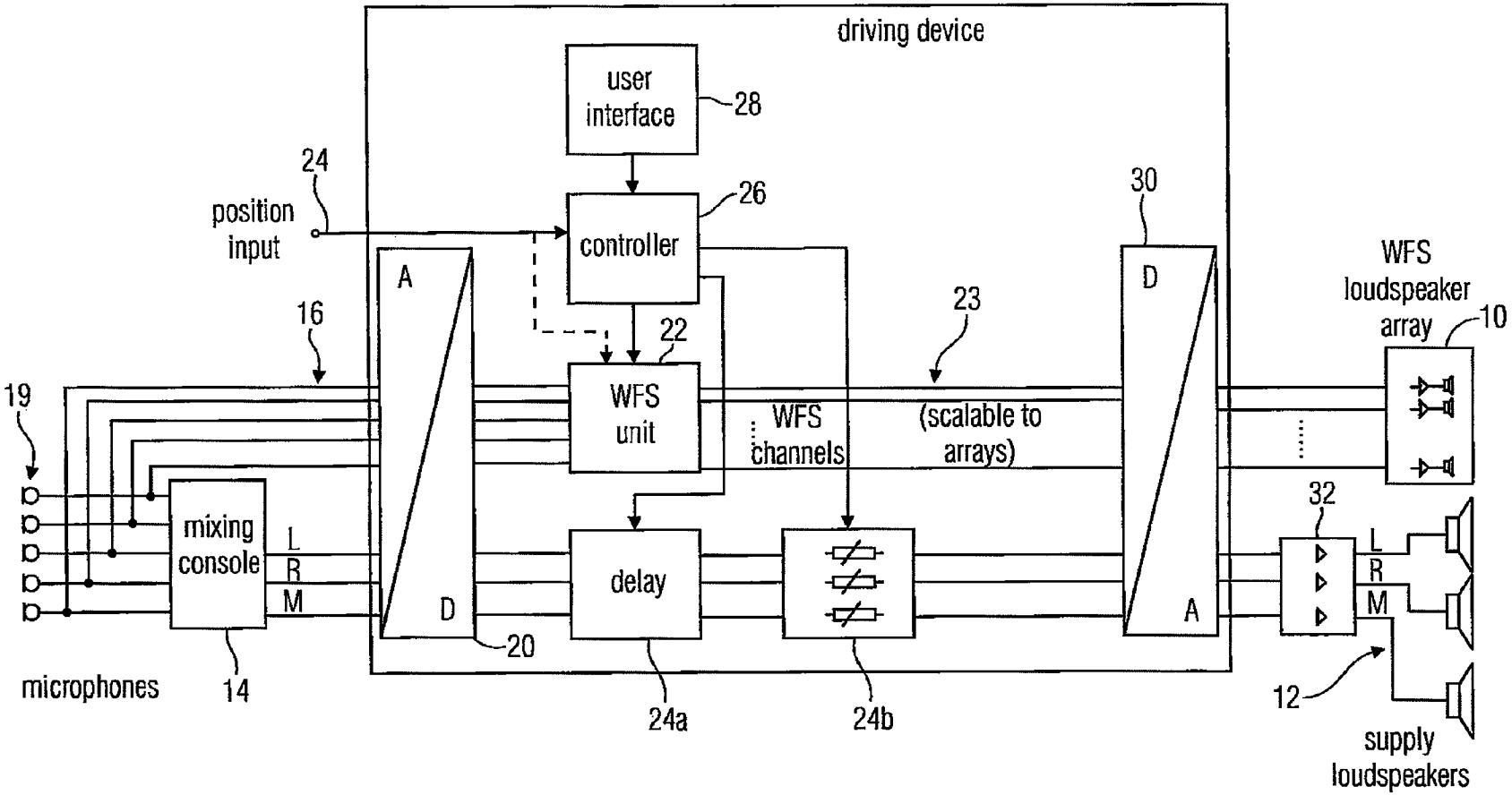
FIG. 1 shows an embodiment of a device for driving a sound system by loudspeaker signals.

FIG. 1 shows a device for driving a sound system by loudspeaker signals, the sound system comprising a wave field synthesis loudspeaker array 10 and one or several supply loudspeakers 12 which are arranged separate from the wave field synthesis loudspeaker array 10 and in the embodiment shown in FIG. 1 are referred to by L for a left supply loudspeaker, R for a right supply loudspeaker and M for a mono or central loudspeaker. Depending on the embodiment, only a mono loudspeaker M may be present, or a left loudspeaker L or a right loudspeaker R.

Figure 2:
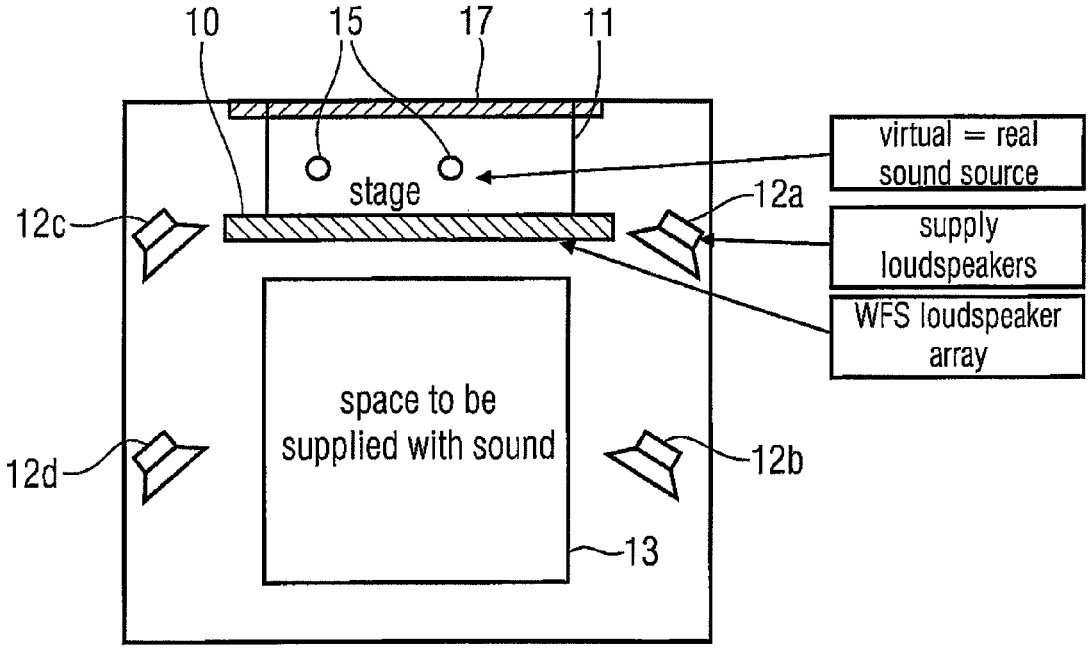
FIG. 2 shows a design of a sound system for a space in front of a stage to be provided with sound.

A certain arrangement of the supply loudspeakers 12 is also illustrated in FIG. 2, wherein there are only four supply loudspeakers 12*a*, 12*b*, 12*c*, 12*d*, the left supply loudspeakers 12*c*, 12*d* being supplied by the L channel of the stereo signal, whereas the right loudspeakers 12*b*, 12*c* are supplied by the right stereo signal. There is no mono or central loudspeaker in, for example, FIG. 2.

However, in principle any loudspeaker 12*a*-12*d* may be supplied by the mono channel M. In this case, the entire space 13 to be provided with sound would be supplied by a mono signal emitted by the four loudspeakers.

In the embodiment of a sound system shown in FIG. 2, the wave field synthesis loudspeaker array 10 is arranged in front of a stage 11 on which there may be real sound sources, such as, for example, speakers, theatre actors, musicians, etc., which in FIG. 2 are generally referred to by the reference numeral 15. The wave field synthesis loudspeaker array 10 is a flat open array. This means that the wave field synthesis loudspeaker array does not extend around all four sides of the space 13 illustrated in FIG. 2 from the top to be provided with sound, but only on the one side. This side advantageously is arranged, with regard to the space to be supplied with sound, where the virtual/real sound sources typically present may be. In a theatre, for example, it can usually be assumed that the actors will only be on the stage, but not at the sides with regard to the audience or behind the audience. Thus, to be able to spatially resolve these sound sources, it is sufficient for a wave field synthesis loudspeaker array to be arranged on the side of the space 13 to be provided with sound which is opposite to the stage 11 or the area in which sound sources may really be. However, it is irrelevant whether the wave field synthesis loudspeaker array 10 is arranged between the real sound sources and the space 13 to be provided with sound, i.e. like as illustrated in FIG. 2, or whether the wave field synthesis loudspeaker array 10 is arranged behind the real sound sources, i.e. in a position 17 illustrated in FIG. 2 by broken lines.

With an arrangement of the array behind the real sound sources, however, shadowings by actors, props, etc. are to be taken into consideration. Furthermore, a high sound level may develop on the stage, which may become a feedback danger. For these reasons, an arrangement in front of the stage is of advantage.

The real sound sources, as are indicated in FIG. 2 on the stage 11, are mapped by the wave field synthesis unit which will be explained in greater detail below to virtual sound sources such that a sound field reconstructed by the wave field synthesis loudspeaker array will be designed such that a listener in the space 13 to be provided with sound will truly think that the sound sources he or she is listening to are at the real position on the stage, in the case of the wave field synthesis loudspeaker array 10 shown in FIG. 2 behind the loudspeaker array.

It is to be pointed out at this stage that the scenario of FIG. 2 may in a certain way be compared to a normal wave field synthesis setting, wherein, however, in contrast to the normal setting, the wave field synthesis loudspeaker array 10 is only arranged on one side, namely on the stage side, whereas in a normal wave field synthesis setting the wave field synthesis loudspeaker array would extend at least around the entire space 13 to be provided with sound, wherein, maybe, wave field synthesis loudspeaker arrays may even be applied in the ceiling and the ground.

Using an open wave field synthesis loudspeaker array 10 and substituting the normal remaining wave field synthesis loudspeaker arrays by the supply loudspeakers 12*a*-12*d* have the result that the sources 15 which are arranged either in front of or behind the wave field synthesis loudspeaker array 10 are acoustically reconstructed almost as precisely for the space 13 to be provided with sound as if there were a continuous surrounding array. The reason for this is that the considerable contribution to reconstructing the sources 15 comes from the wave field synthesis loudspeaker array 10 which is, for example, arranged in front of the space to be provided with sound. On the other hand, the supply loudspeakers 12*a*-12*d* provide for a sufficiently high level over the entire space 13 to be provided with sound, however require considerably less expenditure and cost than a continuous wave field synthesis array.

This will be all the more important when existing systems are improved by the inventive concept, since there are no additional costs for the supply loudspeakers which are already there anyway. The input signals thereof will only be post-processed by the driving device illustrated in FIG. 1, compared to the existing mixing console which has typically been present and is referred to in FIG. 1 by 14, as will be explained in greater detail below referring to FIG. 1.

The driving device of FIG. 1 includes an audio input 16, via which output signals are fed from a microphone array 19 or any other audio source to an analog-to-digital converter 20. The audio input 16 in the scenario shown in FIG. 1 in which there are actually microphones, receives analog microphone signals. If, however, the microphones 19 and the analog-to-digital converter 20 are replaced by a synthetic scenario in which certain sound sources, the output signals of which have already been recorded, move in a virtual space, the audio input 16 will not receive analog output signals of a microphone array 19 but—put generally—audio signals from at least one sound source which may be in any form, exemplarily in a compressed/coded form or in the form of a sequence of sample values, as are, for example, present on a CD.

The audio signal of at least one sound source is fed to a wave field synthesis unit 22 which additionally receives information on the current position of this sound source via a position input 24.

Alternatively, the additional positioning signal may be fed to the control unit and not directly to the WFS unit. In this—advantageous—case, the sources are thus positioned on the user surface or above the positioning input.

If the situation illustrated in FIG. 1 is not a synthetic situation, the current position of the sound source which has been recorded before and the position of which has been determined can actually be provided directly with the audio signal of the wave field synthesis unit 22. The position of the source may also be transferred as side information of the audio signal. In this case, the audio signal input and the position input coincide.

In a conference scenario in which a speaker moves, or in a theatre scenario in which an actor moves, this actor will carry one of the microphones of the microphone array 19 and also be provided with, for example, a GPS transmitter in order for his or her position to be determined currently. Different techniques, such as, for example, by means of infrared triangulation or by RF triangulation or by any other method of determining a position, are known.

If the microphone array 19 has a fixed location in an audience space, the wave field synthesis unit 22 will obtain at least the natural fixed position of all the microphones via the position input 24 and perform a reconstruction starting from this.

The wave field synthesis unit 22 is implemented to calculate loudspeaker signals for the loudspeakers of the wave field synthesis loudspeaker array based on the position obtained via the position input 24, the audio signal obtained via the audio signal input 16, and based on the position of the loudspeakers of the wave field synthesis loudspeaker array so that a sound field produced by the wave field synthesis loudspeaker array will allow localizing the at least one sound source for a listener.

The down-mixed channels generated by a conventional mixing console 14 (analog or digital or a digital audio workstation), such as, for example, the left channel L, the right channel R and the center channel M or mono channel M, are also input into the inventive driving device, into means for providing the loudspeaker signal for the one or the several supply loudspeakers on the basis of the audio signal from the at least one sound source. This means may in the embodiment shown in FIG. 1 include the analog-to-digital converter 20, a delay stage 24*a* and an amplitude manipulation stage 24*b*. Both stages are driven by a controller 26 advantageously present in the driving device, by delay parameters with regard to the delay stage 24*a* and amplification and/or attenuation parameters with regard to the amplitude manipulation stage 24*b*. Depending on the implementation, all the supply loudspeaker channels may be delayed and/or amplified by the same value or by different values. Advantageously, the controller 26 is operable via a user interface 28, which will typically be a graphical user interface.

Depending on the implementation, the driving device will on the output side be provided with a digital-to-analog converter 30 which, on the one hand, outputs analog output signals for the loudspeakers of the wave field synthesis loudspeaker array 10 and which, on the other hand, outputs loudspeaker signals for the supply loudspeakers L, R, M which in FIG. 1 are referred to by 12, wherein an additional amplifier 32 for amplifying the loudspeaker signals for the supply loudspeakers typically driven by high levels will be present, depending on the implementation.

In the embodiment shown in FIG. 1, the wave field synthesis unit 22 is implemented to provide a scalable number of wave field synthesis channels 23. Depending on the implementation, a loudspeaker of a wave field synthesis loudspeaker array receives a special loudspeaker signal.

Alternatively, driving may also be such that a group of neighboring loudspeakers in the wave field synthesis loudspeaker array are driven by the same loudspeaker signal. As has been explained before, the position of the wave field synthesis loudspeaker array and thus of every individual loudspeaker in the wave field synthesis loudspeaker array is known and is also used like the position input of the sound source for the wave field synthesis calculation.

In the embodiment shown in FIG. 1, the wave field synthesis unit 22 is implemented to be scalable. This means that, depending on the number of wave field synthesis loudspeaker arrays 10 connected to the wave field synthesis unit 22, it will produce a corresponding number of output channels. If, for example, an array requires ten different wave field synthesis loudspeaker signals, a second array of the same size will also require ten wave field synthesis loudspeaker channels so that the wave field synthesis unit 22 will, when two arrays of this kind are connected to it, also provide the corresponding number of loudspeaker signals. This does not only result in doubling the number of loudspeaker signals, but also in a modified calculation due to the wave field synthesis algorithm in which every loudspeaker signal of course also depends on the number and position of other loudspeakers and/or depends on whether there are other loudspeakers provided at different positions or not.

Scalability may be implemented by a sensor detecting whether, for example, a fiberglass wire for a wave field synthesis loudspeaker array is connected to an output of the driving device of FIG. 1 or not. Typically, the outputs will be referred to by "first array", "second array", . . . , so that the driving device will automatically receive positions and numbers of additional arrays, for example by accessing a map or something similar.

Alternatively, the number of channels/arrays of the wave field synthesis unit 22 may also be communicated via the graphical user interface 28 and the controller 26.

For the inventive scenario, scalability is particularly valuable since only one open wave field synthesis array is used anyway, i.e. no loudspeaker bands surrounding a listener space, but only on the stage side of the listener space so that for the case in which a straight array is placed subsequent to a straight array already present, the positions of the further loudspeakers are recovered particularly favorably, exemplarily by means of accessing a map, and may be made available for the wave field synthesis unit 22 for calculating the then higher number of wave field synthesis loudspeaker signals.

In an embodiment of the present invention, the controller 26 is implemented to drive the delay stage 24*a* such that the loudspeaker signals are delayed so that the wave front, due to the wave field synthesis loudspeaker array 10, will arrive at a listener around 2 to 10 milliseconds before the point in time when the wave front of the supply loudspeakers arrives. Thus, the law of the first sound wave front made use of in that the listener in the space will at first—relatively softly—perceive the wave front from the wave field synthesis loudspeaker array 10 and only then the wave front from the typically louder supply loudspeakers. The user will get the impression that the sound sources are at those positions feigned by the wave field synthesis loudspeaker array, although the actual sound supply is by the supply loudspeakers.

Considering the fact that for the front listener space a sound supply takes place by the wave field synthesis loudspeaker array 10 which is not perceived as a point source with greatly decreasing levels, but as an area source having a more pleasant level distribution, at least the front supply loudspeakers can then be reduced with regard to their amplitudes and/or their output levels, which may take place by the controller 26 driving the amplitude manipulation unit 24*b* correspondingly to either attenuate all the channels and/or only some channels and/or signals for special loudspeakers by the same magnitude or by different magnitudes.

Subsequently, the wave field synthesis technique will be discussed in greater detail for an improved understanding of the present invention.

An improved natural space experience and a stronger enclosure in audio reproduction can be achieved using a novel technology. The basics of this technology, the so-called wave field synthesis (WFS) were investigated at the Technical University of Delft and first presented in the late 80s (A. J. Berkhout; D. de Vries, P. Vogel: Acoustic control by Wave-field Synthesis. JASA 93, 1993).

As a consequence of the enormous requirements of this method to computer performance and transfer rates, wave field synthesis has up to now only rarely been employed in practice. Only the progress in the fields of microprocessor technology and audio coding allow this technology to be used today in specific applications. First products in the professional field are expected for next year. First wave field synthesis applications for the consumer area are to be launched on the market within the next few years.

The basic idea of WFS is based on applying Huygens' principle of wave theory:

Every point detected by a wave is the starting point of an elementary wave propagating in a spherical and/or circular manner.

Applied to acoustics, any form of an incoming wave front may be reproduced by a great number of loudspeakers arranged next to one another (in a so-called loudspeaker array). In the most simple case of a single point source to be reproduced and a linear arrangement of loudspeakers, the audio signals of every loudspeaker have to be fed with a time delay and amplitude scaling such that the sound fields emitted of the individual loudspeakers overlap correctly. With several sound sources, the contribution to every loudspeaker is calculated separately for every source and the resulting signals are added. If the sources to be reproduced are in a space with reflecting walls, reflections, too, must be reproduced as additional sources via the loudspeaker array. The calculating complexity thus is strongly dependent on the number of sound sources, the reflection characteristics of the recording space and the number of loudspeakers.

The advantage of this technology particularly is that a natural spatial sound experience is possible over a large area of the reproduction space. In contrast to known techniques, direction and distances to sound sources are reproduced very precisely. To a limited extent, virtual sound sources may even be positioned between the real loudspeaker array and the listener.

Although wave field synthesis works well for surroundings the qualities of which are known, anomalies occur when the quality changes and/or when wave field synthesis is performed on the basis of a quality of the surroundings not matching the actual quality of the surroundings.

The quality of the surroundings may be described by the impulse response of the surroundings.

This will be discussed in greater detail referring to the following example. It is assumed that a loudspeaker emits a sound signal against a wall the reflection of which is undesired. For this simple example, the spatial compensation using wave field synthesis would be to first determine the reflection of this wall to find out when a sound signal having been reflected by the wall arrives again at the loudspeaker and which amplitude this reflected sound signal has. When the reflection from this wall is undesired, wave field synthesis offers a way of eliminating the reflection from this wall by impressing on the loudspeaker a signal opposite in phase to the reflection signal having a corresponding amplitude in addition to the original audio signal so that the approaching compensation wave deletes the reflection wave such that the reflection from this wall is eliminated in the surroundings considered. This may take place by at first calculating the impulse response of the surroundings and then determining the quality and position of the wall on the basis of the impulse response of these surroundings, wherein the wall is interpreted as a mirror source, i.e. a sound source reflecting incident sound.

If at first the impulse response of these surroundings is measured and then the compensation signal to be impressed on the loudspeaker superpositioning the audio signal is calculated, a deletion of the reflection from this wall will take place such that a listener in these surroundings will get a sound experience of this wall not existing at all.

However, it is decisive for optimum compensation of the reflected wave that the impulse response of the space be determined precisely in order for no over- or under-compensation to arise.

Thus, wave field synthesis allows correct mapping of virtual sound sources over a large reproduction region. At the same time, it offers a novel technological and creative potential for sound recordists and sound engineers when establishing complex sound scenes. The wave field synthesis (WFS or sound field synthesis), as developed at the end of the 80s at the Technological University of Delft, represents a holographic approach of sound reproduction. The Kirchhoff-Helmholtz integral serves as a basis for this. It states that any sound fields can be generated within a closed volume by means of a distribution of monopole and dipole sound sources (loudspeaker arrays) on the surface of this volume. Details of this can be found in M. M. Boone, E. N. G. Verheijen, P. F. v. Tol, "Spatial Sound-Field Reproduction by Wave-Field Synthes is", Delft University of Technology Laboratory of Seismics and Acoustics, Journal of J. Audio Eng. Soc., Vol. 43, No. 12, December 1995 and Diemer de Vries, "Sound Reinforcement by Wavefield Synthesis: Adaption of the Synthesis Operator to the Loudspeaker Directivity Characteristics", Delft University of Technology Laboratory of Seismics and Acoustics, Journal of J. Audio Eng. Soc., Vol. 44, No. 12, December 1996.

In wave field synthesis, a synthesis signal for every loudspeaker of the loudspeaker array is calculated from an audio signal which a virtual source emits at a virtual position, wherein the synthesis signals are designed with regard to amplitude and phase such that a wave resulting from the superpositioning of the individual sound wave output by the loudspeakers in the loudspeaker array corresponds to the wave which would result from the virtual source at the virtual position if this virtual source at the virtual position were a real source having a real position.

Typically, there are several virtual sources at different virtual positions. Calculating the synthesis signals is performed for every virtual source at every virtual position so that typically a virtual source results in synthesis signals for several loudspeakers. Considered from the point of view of a loudspeaker, this loudspeaker thus receives several synthesis signals going back to different virtual sources. A superposition of these sources which is possible due to the linear superposition principle, will then result in the reproduction signal actually emitted by the loudspeaker.

The possibilities of wave field synthesis can be made use of the better, the larger the loudspeaker arrays, i.e. the more individual loudspeakers are provided. However, this also increases the calculating power a wave field synthesis unit has to perform since typically channel information must also be considered. This particularly means that principally there is a special transfer channel from each virtual source to each loudspeaker and that in principle it may be the case that every virtual source results in a synthesis signal for every loudspeaker and/or that every loudspeaker receives a number of synthesis signals equaling the number of virtual sources.

In addition, it is pointed out here that the quality of audio reproduction increases with an increasing number of loudspeakers made available. This means that the audio reproduction quality will become the better and more realistic, the more loudspeakers there are in the loudspeaker array/s.

In the above scenario, the completely rendered reproduction signals subjected to an analog-to-digital converting for the individual loudspeakers may exemplarily be transferred via two-wire lines from the wave field synthesis central unit to the individual loudspeakers. This would have the advantage that it is virtually ensured that all the loudspeakers work synchronously so that no further measures would be necessary here for synchronization purposes. On the other hand, the wave field synthesis central unit could only be produced for one special reproduction space and/or for a reproduction having a fixed number of loudspeakers. This means that a special wave field synthesis central unit which would have to perform a considerable amount of calculating power would have to be produced for every reproduction space, since in particular with regard to many loudspeakers and/or many virtual sources the calculation of the audio reproduction signals has to take place at least partly parallel and in real time.

Essential aspects of the present invention will be summarized again subsequently. A front array 10 based on wave field synthesis of FIG. 1 reproduces all the sound sources recorded from the correct direction and distance so that the source will be heard where it forms. These virtual sound sources are reproduced with the shortest latency caused by the system. Essential latency sources are the wave field synthesis unit 22 and, maybe, the analog-to-digital converter 20 and/or 30. The main sound reproduces conventional mono/stereo/multi-channel signals, however is delayed by a few milliseconds compared to the front array, wherein the delay will be in the range of 2-100 milliseconds and advantageously between 3 and 8 milliseconds.

The main sound by the supply loudspeakers 12 provides sound to the auditory with a sufficient level. The front array in contrast operates at a reduced level to support directional perception discreetly. If the front array is located optimally, a real directional experience will result up to the back rows, wherein a sufficient sound distribution is ensured.

The driving device shown in FIG. 1 may be realized as a compact audio system on a PC or DSP basis including an audio crossbar, a delay unit, a real time rendering unit based on wave field synthesis, a controller module and terminal and operating units.

The audio signals of natural sources, such as, for example, speakers, artists, etc., are conventionally made available to the summing unit and/or the mixer 14 and the wave field synthesis rendering unit.

In the summing unit, the audio signals for conventional sound systems, such as, for example, stereo, mono, 5.1, etc., are generated (14) and subsequently delayed correspondingly in a delay stage 24*a*. In addition, in a following level stage 24*b*, the amplitude may be adjusted between the main sound and the directive array.

On the other hand, the individual sources in the wave field synthesis rendering unit 22, as is explained, become virtual sound sources which are positioned or moved corresponding to their actual position on the stage. The wave field synthesis rendering unit 22 calculates the audio signals required for the wave field synthesis front array, thus ensuring a real directional mapping of the audio sources.

In the central control unit 26 and the operating unit 28, the virtual sound sources are positioned depending on the implementation so that in this case the user interface 28 represents the position input 24 of FIG. 1 in for example the form of an indicator. In addition, the delay of the stage 24*a* and the level between the front array, main sound, delay line and other audio sinks is adjusted in the user interface unit 28 and/or in the controller. Advantageously, the corresponding setups produced can each be stored so that they do not have to be set again every time but may be made available for later or different applications/scenarios.

Referring to the placing of the wave field synthesis front array in conventional stage surroundings, it is of advantage for the wave field synthesis front array to be arranged at the height of the heads of the audience or above the height of the heads of the audience and be placed in front of the stage. In addition, it is of advantage to use a wave field synthesis front array 10 which is wider than the audience rows in order to avoid edge effects at the array edge.

In summary, the inventive concept provides a real directional perception by representing virtual sound sources on the basis of wave field synthesis. In additional, no angular errors are made in the directional resolution. Furthermore, virtual sound sources may be placed where the actor is standing. Movements of the actors are possible without cross-fading. Static sources in contrast remain stable. The sound supply of the auditory with a sufficient sound level is still ensured by standard systems, allowing hardware already present still to be used optimally. By integrating the additional wave field synthesis front array and by providing the inventive driving device, however, the result is a system with additional positioning capability of the sources localizable.

With regard to known wave field synthesis arrays, the inventive concept does not require a closed array for supplying the audible region since the supply can be ensured by means of conventional sound. The result is a moderate sound level, in particular in the first rows of the audience since the sound energy is distributed. Several loudspeakers of the wave field synthesis loudspeaker array will operate, resulting in natural audio surroundings, in particular in the first rows of the audience, this being typically where persons who are of decisive importance for the survival of a theatre/auditory and thus are to be catered for particularly well are seated.

In order to reduce shadowings by listeners with a non-optimum arrangement of the front array, the wave field synthesis array is positioned somewhat above the heads of the audience. Even higher-up arrangements are potentially possible, wherein too high an arrangement, however, will result in possible incorrect localizations in the vertical. It has been found out that, due to psycho-acoustical laws, incorrect vertical localizations are less problematic than incorrect horizontal localizations. Thus, it is not too problematic for a listener when he or she hears a source from somewhat too high when the left/right position on the stage in return match precisely.

In order to avoid undesired interferences of both systems, i.e. of the supply loudspeakers and the wave field synthesis loudspeaker array, both loudspeaker systems are either driven synchronously or, as has been discussed, such that the wave front of the wave field synthesis loudspeaker array arrives at the listener somewhat before the wave front of the supply loudspeakers.

Conference rooms are advantageous fields of application of the inventive concept. The inventive device allows localizing a speaker. Several speakers become several localizable virtual/real sound sources, which is of particularly great advantage for situations in which there may be understanding problems anyway, i.e. when persons of different nationalities are talking to one another. Here, a spatial separation of the individual speakers supports the acoustic understandability of all speakers, in particular when several persons are talking at the same time.

In interpreting equipment, too, the inventive concept allows localizing the speaker not only visually but also auditively.

The inventive device may be applied particularly well in the field of theatre since frequently support loudspeakers cannot be installed in the stage setting. Here, installing a continuous loudspeaker band into the edge of the stage is of particular advantage and is less conspicuous. In particular, the functionality of the inventive concept, namely that sound sources can move and correspondingly also be moved acoustically, is of particular advantage for theatre applications relying on the actors moving.

For concert venues, too, the inventive concept provides a resolution of individual instruments by virtual sound sources, whereas nevertheless an overall supply with the usual level is possible, which is of particularly high importance for popular music concerts.

Depending on the circumstances, the inventive method may be implemented in either hardware or software. The implementation may be on a digital storage medium, in particular on a disc or CD having control signals which may be read out electronically which can cooperate with a programmable computer system such that the method will be executed. Generally, the invention thus also is in a computer program product having a program code stored on a machine-readable carrier for performing the inventive method when the computer program product runs on a computer. Put differently, the invention may thus also be realized as a computer program having a program code for performing the method when the computer program runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A device for driving a sound system by loudspeaker signals, the sound system comprising a wave field synthesis loudspeaker array and one or several supply loudspeakers arranged separate from the wave field synthesis loudspeaker array, the device comprising:

an audio input configured to receive at least one audio signal from at least one sound source;

a position input configured to receive information on a position of the sound source;

a processor connected to the audio input and to the position input, wherein the processor includes instructions for calculating loudspeaker signals for the loudspeakers of the wave field synthesis loudspeaker array based on the position of the audio signal obtained from the position input, based on the audio signal obtained from the audio input and based on a position of the loudspeakers of the wave field synthesis loudspeaker array so that a sound field produced by the wave field synthesis loudspeaker array allows localizing the sound source by a listener in a space supplied by the supply loudspeakers; and a provider connected to the audio input configured to provide the loudspeaker signal for the one or the several supply loudspeakers on the basis of the audio signal obtained from the audio input, wherein the device is implemented to drive the wave field synthesis loudspeaker array and the one or the several supply loudspeakers such that a wave front of the wave field synthesis loudspeaker array arrives at a listener before a wave front of the one or the several supply loudspeakers, and wherein at least one of the audio input, the position input, the processor, and the provider comprises a hardware implementation.

2. The device according to claim 1, wherein the provider is implemented to provide a mono signal, a stereo signal or a multi-channel signal derived by mixing from the audio signal of the one or the several sound sources.

3. The device according to claim 1, wherein the provider further comprises a delay unit which is implemented to delay the loudspeaker signal for the one or the several supply loudspeakers depending on a delay of the processor such that a wave front of the supply loudspeakers arrives later at a listener than a wave front caused by the wave field synthesis loudspeaker array.

4. The device according to claim 3, wherein the delay unit is implemented to delay the loudspeaker signal for the one or the several supply loudspeakers by 1 to 100 ms more than the delay of the processor.

5. The device according to claim 1, further comprising a level-controlling unit which is implemented to control the loudspeaker signals for the one or the several supply loudspeakers or the loudspeaker signals for the wave field synthesis loudspeaker array such that a sound level caused by the wave field synthesis loudspeaker array is smaller than a sound level of the one or the several supply loudspeakers in at least a certain region of the space.

6. The device according to claim 1, wherein the processor includes instructions for providing a scalable number of wave field synthesis loudspeaker signals.

7. The device according to claim 1, wherein the processor includes instructions for calculating a number of loudspeaker signals which is greater than a number of loudspeaker signals for the one or the several supply loudspeakers.

8. The device according to claim 7, wherein the number of loudspeaker signals for the wave field synthesis loudspeaker array is at least three times as large as a number of loudspeaker signals for the supply loudspeakers.

9. The device according to claim 1, wherein the processor includes instructions for:

calculating, when the at least one sound source comprises a single sound source, time delays and amplitude scalings for the audio signal of the single sound source to obtain the loudspeaker signals for the loudspeakers of the wave field synthesis loudspeaker array, or calculating, when the at least one sound source comprises a plurality of sound sources, a contribution from each sound source for each loudspeaker separately and to superpose the individual contributions from the plurality of sound sources for each loudspeaker to obtain the loudspeaker signals for the loudspeakers of the wave field synthesis loudspeaker array.

10. A sound system, comprising:

a wave field synthesis loudspeaker array;

one or several supply loudspeakers; and a device for driving a sound system by loudspeaker signals, the sound system comprising the wave field synthesis loudspeaker array and the one or several supply loudspeakers arranged separate from the wave field synthesis loudspeaker array, comprising:

an audio input configured to receive at least one audio signal from at least one sound source;

a position input configured to receive information on a position of the sound source;

a processor connected to the audio input and to the position input, and connected to the wave field synthesis loudspeaker array, wherein the processor includes instructions for calculating loudspeaker signals for the loudspeakers of the wave field synthesis loudspeaker array based on the position of the audio signal obtained from the position input, based on the audio signal obtained from the audio input and based on a position of the loudspeakers of the wave field synthesis loudspeaker array so that a sound field produced by the wave field synthesis loudspeaker array allows localizing the sound source by a listener in a space supplied by the supply loudspeakers; and a provider connected to the audio input, and connected to the one or several supply loudspeakers, wherein the provider is configured to provide the loudspeaker signal for the one or the several supply loudspeakers on the basis of the audio signal obtained from the audio input, wherein the device for driving is implemented to drive the wave field synthesis loudspeaker array and the one or the several supply loudspeakers such that a wave front of the wave field synthesis loudspeaker array arrives at a listener before a wave front of the one or the several supply loudspeakers.

11. The sound system according to claim 10, arranged in a space comprising a front edge, a left edge and a right edge, wherein there are at least two supply loudspeakers, of which one is arranged at the left edge and one is arranged at the right edge, and wherein the wave field synthesis loudspeaker array is arranged at the front edge.

12. The sound system according to claim 11, wherein the front edge abuts on a region for a sound source.

13. The sound system according to claim 12, wherein the region is a stage or a speaker region of a lecture hall.

14. The sound system according to claim 11, wherein the wave field synthesis loudspeaker array is a flat array in which the loudspeakers are positioned in a plane at predetermined distances from one another.

15. The sound system according to claim 12, wherein the wave field synthesis loudspeaker array is installed in the edge of a stage at the height of the heads of the audience in the space to be provided with sound or above this height of the heads.

16. The sound system according to claim 10, wherein the processor includes instructions for:

calculating, when the at least one sound source comprises a single sound source, time delays and amplitude scalings for the audio signal of the single sound source to obtain the loudspeaker signals for the loudspeakers of the wave field synthesis loudspeaker array, or calculating, when the at least one sound source comprises a plurality of sound sources, a contribution from each sound source for each loudspeaker separately and to superpose the individual contributions from the plurality of sound sources for each loudspeaker to obtain the loudspeaker signals for the loudspeakers of the wave field synthesis loudspeaker array.

* * * * *